US011976541B2

(12) United States Patent
Curry et al.

(10) Patent No.: US 11,976,541 B2
(45) Date of Patent: May 7, 2024

(54) SYSTEM AND METHOD FOR AN AUTOMATED AND INTELLIGENT FRAC PAD

(71) Applicant: FMC Technologies, Inc., Houston, TX (US)

(72) Inventors: Zachary Curry, Houston, TX (US); Andrew Cappello, Houston, TX (US); Thiago Machado, Houston, TX (US); James Cook, Houston, TX (US); Sobitha Gunatilleke, Houston, TX (US); Rajeev Pillai, Houston, TX (US); Hernan Anzola, Houston, TX (US); Nathanial Ramsey, Houston, TX (US); Clay Dixon, Houston, TX (US); Gabriel Tiviroli-Melchert, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 164 days.

(21) Appl. No.: 17/608,093

(22) PCT Filed: May 18, 2020

(86) PCT No.: PCT/US2020/033383
§ 371 (c)(1),
(2) Date: Nov. 1, 2021

(87) PCT Pub. No.: WO2020/236703
PCT Pub. Date: Nov. 26, 2020

(65) Prior Publication Data

US 2022/0316307 A1 Oct. 6, 2022

Related U.S. Application Data

(60) Provisional application No. 62/849,375, filed on May 17, 2019.

(51) Int. Cl.
*E21B 43/26* (2006.01)

(52) U.S. Cl.
CPC ..... *E21B 43/2607* (2020.05); *E21B 2200/20* (2020.05)

(58) Field of Classification Search
CPC ... E21B 2200/20; E21B 43/26; E21B 43/2607
See application file for complete search history.

(56) References Cited

U.S. PATENT DOCUMENTS 9,920,878 B2 3/2018 Beck et al.
2014/0290768 A1 10/2014 Randle et al.
(Continued)

FOREIGN PATENT DOCUMENTS

CA 2881718 A1 2/2014
CA 2919049 A1 2/2015
(Continued)

OTHER PUBLICATIONS

International Search Report issued in International Application No. PCT/US2020/033383 dated Oct. 27, 2020 (6 pages).
(Continued)

*Primary Examiner* — Matthew R Buck
(74) *Attorney, Agent, or Firm* — Osha Bergman Watanabe & Burton LLP

(57) ABSTRACT

A system includes a built hydraulic fracturing system with a plurality of devices connected together and a simulation of the built hydraulic fracturing system on a software application. Additionally, a fracturing plan may be provided on the software application to include pre-made instructions to perform multiple processes in a hydraulic fracturing operation such as a sequence of valve operations to direct fluid flow through a selected path. Further, the fracturing plan may be modified to create a customized fracturing plan including the pre-made instructions and at least one modi-
(Continued)

fied instruction. Furthermore, the customized fracturing plan may be executed to perform at least one of the processes in the built hydraulic fracturing system.

10 Claims, 6 Drawing Sheets

(56) References Cited

U.S. PATENT DOCUMENTS

| | | | | |
|---|---|---|---|---|
| 2014/0352968 | A1 | 12/2014 | Pitcher et al. | |
| 2015/0345272 | A1 | 12/2015 | Kajaria et al. | |
| 2015/0354322 | A1 | 12/2015 | Vicknair et al. | |
| 2016/0230513 | A1* | 8/2016 | Dykstra | E21B 43/26 |
| 2019/0120024 | A1* | 4/2019 | Oehring | E21B 43/26 |
| 2021/0102461 | A1* | 4/2021 | Kumar | E21B 49/008 |
| 2021/0406792 | A1* | 12/2021 | Bhardwaj | G06Q 10/06393 |
| 2022/0025753 | A1* | 1/2022 | Heidari | E21B 49/005 |
| 2022/0027538 | A1* | 1/2022 | Walters | G06F 30/28 |

FOREIGN PATENT DOCUMENTS

| | | | | |
|---|---|---|---|---|
| CA | 3034539 | A1 | 3/2018 | |
| CN | 103392054 | A | 11/2013 | |
| CN | 104956137 | A | 9/2015 | |
| CN | 105919149 | A | 9/2016 | |
| CN | 109323116 | A | 2/2019 | |
| CN | 109415935 | A | 3/2019 | |
| WO | 2016108872 | A1 | 7/2016 | |
| WO | WO-2018182444 | A1 * | 10/2018 | C09K 8/64 |

OTHER PUBLICATIONS

Written Opinion issued in International Application No. PCT/US2020/033383 dated Oct. 27, 2020 (11 pages).

Office Action issued in Chinese Application No. 202080036753.1, dated Mar. 6, 2023 (8 pages).

Office Action issued in Canadian patent application No. 3,138,942, dated Aug. 16, 2023 (4 pages).

* cited by examiner

SYSTEM AND METHOD FOR AN AUTOMATED AND INTELLIGENT FRAC PAD

BACKGROUND

Hydraulic fracturing is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area. Furthermore, hydraulic fracturing is used to increase the rate at which fluids, such as petroleum, water, or natural gas can be recovered from subterranean natural reservoirs. Reservoirs are typically porous sandstones, limestones or dolomite rocks, but also include "unconventional reservoirs" such as shale rock or coal beds. Hydraulic fracturing enables the extraction of natural gas and oil from rock formations deep below the earth's surface (e.g., generally 2,000-6,000 m (5,000-20,000 ft)), which is greatly below typical groundwater reservoir levels. At such depth, there may be insufficient permeability or reservoir pressure to allow natural gas and oil to flow from the rock into the wellbore at high economic return. Thus, creating conductive fractures in the rock is instrumental in extraction from naturally impermeable reservoirs.

A wide variety of hydraulic fracturing equipment is used in oil and natural gas fields such as a slurry blender, one or more high-pressure, high-volume fracturing pumps and a monitoring unit. Additionally, associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Fracturing equipment operates over a range of pressures and injection rates, and can reach up to 100 megapascals (15,000 psi) and 265 litres per second (9.4 cu ft/s) (100 barrels per minute).

With the wide variety of hydraulic fracturing equipment at a well site, the hydraulic fracturing operation may be conducted. A hydraulic fracturing operation requires planning, coordination, and cooperation of all parties. Safety is always the primary concern in the field, and it begins with a thorough understanding by all parties of their duties. Additionally, before a hydraulic fracturing operation, a worker, rig personal, or an engineer may conduct a detailed inventory of all the equipment and materials on location. The inventory should be compared with the design and the prognosis. After the hydraulic fracturing operation has concluded, another inventory of all the materials left on location should be conducted. In most cases, the difference in the two inventories can be used to verify what was mixed and pumped into the wellbore and the hydrocarbon-bearing formation. Conventional hydraulic fracturing operations are dependent on workers being present to oversee and conduct said operation over the full life-time to complete said operation.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, this disclosure relates to a method that may include providing a template fracturing plan on a software application. Additionally, the template fracturing plan may include pre-made instructions to perform multiple processes carried out by a generic hydraulic fracturing system. Further, the method may include modifying the template fracturing plan to create a customized fracturing plan including the pre-made instructions and at least one modified instruction, and executing the customized fracturing plan to perform at least one of the processes in a built hydraulic fracturing system comprising a plurality of devices.

In another aspect, this disclosure relates to a method that may include mapping a plurality of devices in a hydraulic fracturing system into a simulated hydraulic fracturing system using a software application. Additionally, the method may include adding a new device, which may be firmware, to the hydraulic fracturing system and mapping the new device into the simulated hydraulic fracturing system. Further, the mapping of the new device may include casting a search for signals within a radius encompassing the hydraulic fracturing system, detecting at least one signal from the new device firmware, and communicating the new device firmware with the software application.

In yet another aspect, this disclosure relates to a system that may include a built hydraulic fracturing system with a plurality of devices connected together and a simulation of the built hydraulic fracturing system on a software application. Additionally, the system may further include a fracturing plan provided on the software application, wherein the fracturing plan may include instructions to perform multiple processes in a hydraulic fracturing operation such as a sequence of valve operations to direct fluid flow through a selected path.

In yet another aspect, this disclosure relates to a system that includes a frac tree having at least one valve and being associated with a red zone surrounding the frac tree, a manifold positioned in the red zone and in fluid communication with the valve(s), a control panel positioned outside the red zone, and an automation box positioned within the red zone, where the automation box is electrically connected to the control panel and to the manifold. The automation box may receive electrical power at a first level and outputs electrical power to the manifold and a second level, lower than the first level.

Other aspects and advantages will be apparent from the following description and the appended claims.

DETAILED DESCRIPTION

Figure 1A:
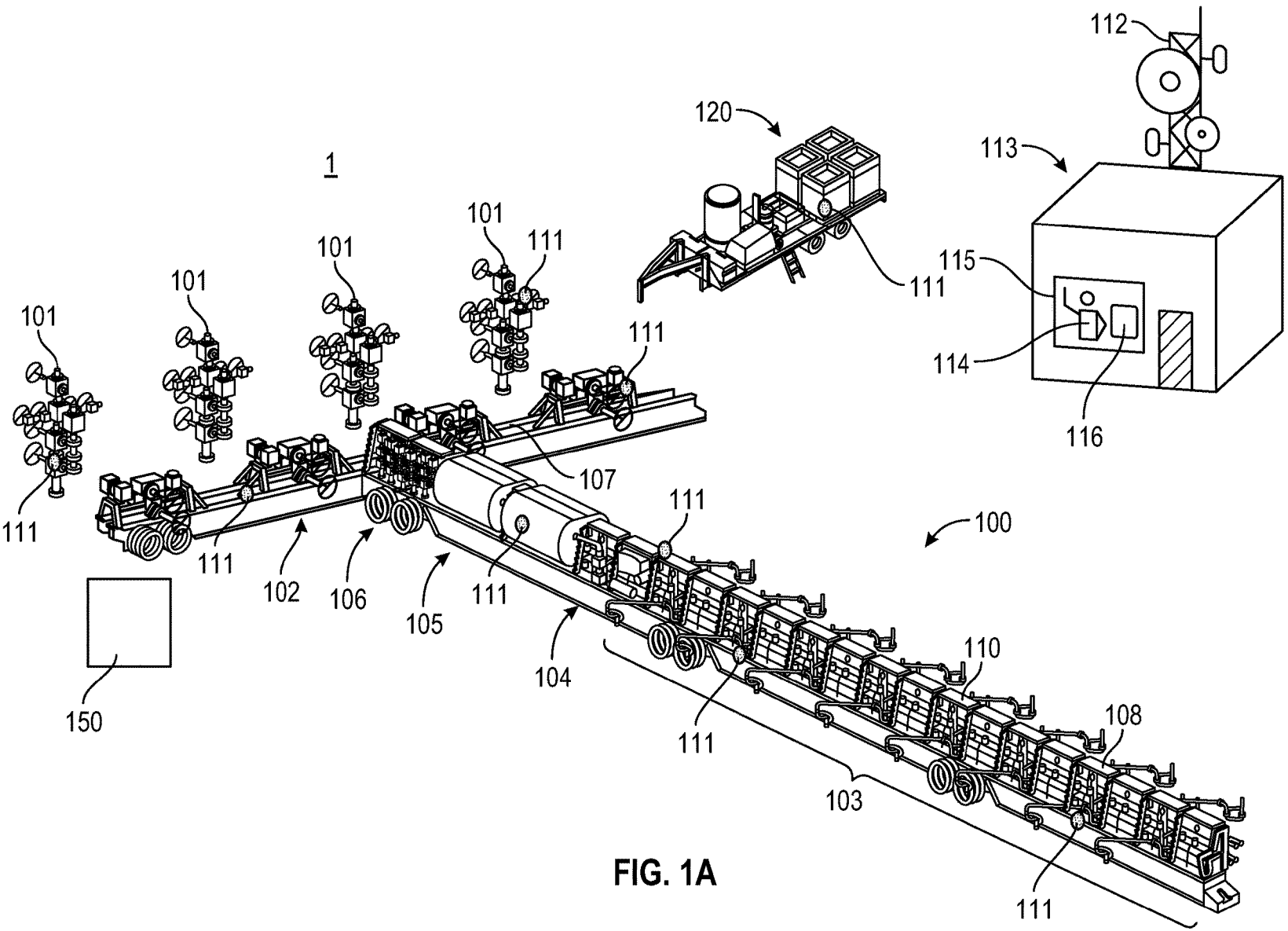
FIGS. 1A-1C illustrate a view of a hydraulic fracturing system at a well site according to one or more embodiments of the present disclosure.

Embodiments of the present disclosure are described below in detail with reference to the accompanying figures. Wherever possible, like or identical reference numerals are used in the figures to identify common or the same elements. The figures are not necessarily to scale and certain features and certain views of the figures may be shown exaggerated in scale for purposes of clarification. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection, and is not limited to either unless expressly referenced as such.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. The embodiments are described merely as examples of useful applications, which are not limited to any specific details of the embodiments herein.

In a fracturing operation, a plurality of equipment (i.e., fracturing equipment) is disposed around a rig site to perform a wide variety of fracturing operations during a life of the fracturing operation (i.e., rig site preparation to fracturing to removal of fracturing equipment) and form a built hydraulic fracturing system. At the site, there is a wide variety of fracturing equipment for operating the fracturing, such as, a slurry blender, one or more high-pressure, high-volume fracturing pumps a monitoring unit, fracturing tanks, one or more units for storage and handling of proppant, high-pressure treating iron, a chemical additive unit (used to accurately monitor chemical addition), low-pressure flexible hoses, and many gauges and meters for flow rate, fluid density, treating pressure, etc. The fracturing equipment encompasses a number of components that are durable, sensitive, complex, simple components, or any combination thereof. Furthermore, it is also understood that one or more of the fracturing equipment may be interdependent upon other components. Once the fracturing equipment is set up, typically, the fracturing operation may be capable of operating 24 hours a day.

Conventional hydraulic fracturing systems in the oil and gas industry typically require an entire team of workers to ensure proper sequencing. For example, a valve team may meet, plan, and agree on a valve sequence to then actuate the valves. As a result, conventional hydraulic fracturing systems are prone to human errors resulting in improper actuation of valves and expensive damage and non-productive time (NPT). In addition, there is no automated log of valve phases and operational information as conventional hydraulic fracturing systems are monitored by workers. As such, conventional hydraulic fracturing systems may fail to have real-time information on how long an activity lasted/duration and data supporting operational improvement or how many times valves have been actuated to determine maintenance requirements or service requirements.

One or more embodiments in the present disclosure may be used to overcome such challenges as well as provide additional advantages over conventional hydraulic fracturing systems. For example, in some embodiments, an automated hydraulic fracturing system including a computing system described herein and a plurality of sensors working in conjunction with built hydraulic fracturing system may streamline and improve efficiency as compared with conventional hydraulic fracturing systems due, in part, to reducing or eliminating human interaction with the hydraulic fracturing systems by automating fracturing operations, monitoring, logging and alerts.

In one aspect, embodiments disclosed herein relate to automating a hydraulic fracturing system that may perform multiple processes in a hydraulic fracturing operation. In another aspect, embodiments disclosed herein relate to simulating hydraulic fracturing systems. Simulations may be used, for example, to plan and/or execute hydraulic fracturing operations. Further, simulating hydraulic fracturing systems may be used in forming and executing automated hydraulic fracturing systems.

Simulated and automated hydraulic fracturing systems may utilize a fracturing plan provided on a software application, which may include pre-made instructions to perform multiple processes carried out by the hydraulic fracturing system. Such fracturing plans may include automating valves within the hydraulic fracturing system to have a valve sequencing (e.g., opening and closing) to direct fluids (e.g., frac fluid) in a selected path and/or control pressure within the system. As used herein, a valve may be interchangeably referred to as a gate valve in the present disclosure. Further, fluids may refer to slurries, liquids, gases, and/or mixtures thereof. In some embodiments, solids may be present in the fluids. Automating a hydraulic fracturing system according to one or more embodiments described herein may provide a cost-effective alternative to conventional hydraulic fracturing systems. The embodiments are described merely as examples of useful applications, which are not limited to any specific details of the embodiments herein.

FIG. 1A shows an automated hydraulic fracturing system according to embodiments of the present disclosure. The automated hydraulic fracturing system includes a built physical hydraulic fracturing system 100 having a plurality of connected together fracturing equipment at a rig site 1. The built hydraulic fracturing system 100 may include at least one wellhead assembly 101 (e.g., a Christmas tree) coupled to at least one time and efficiency (TE) or zipper manifold 102 through one or more flow lines (not shown). The hydraulic fracturing system 100 may further include at least one pump manifold 103 in fluid communication with the zipper manifold 102. In use, the at least one pump manifold 103 may be fluidly connected to and receive pressurized fracking fluid from one or more high pressure pumps (not shown), and direct that pressurized fracking fluid to the zipper manifold 102, which may include one or more valves that may be closed to isolate the wellhead assembly 101 from the flow of pressurized fluid within the zipper manifold 102 and pump manifold 103. Additionally, the at least one wellhead assembly 101 may comprise one or more valves fluidly connected to a wellhead that are adapted to control the flow of fluid into and out of wellhead. Typical valves associated with a wellhead assembly include, but are not limited to, upper and lower master valves, wing valves, and swab valves, each named according to a respective functionality on the wellhead assembly 101.

Additionally, the valves of the at least one wellhead assembly 101 and zipper manifold 102 may be gate valves that may be actuated, but not limited to, electrically, hydraulically, pneumatically, or mechanically. In some embodiments, the built hydraulic fracturing system 100 may include a system 150 that may provide power to actuate the valves of the built hydraulic fracturing system 100. In a non-limited example, when the valves are hydraulically actuated, the system 150 may include a hydraulic skid with accumulators to provide the hydraulic pressure required to open and close the valves, when needed. The system 150 may also be interchangeably referred to as a valve control system in the present disclosure.

Further, the built hydraulic fracturing system 100 includes a plurality of additional rig equipment for fracturing operations. In a non-limiting example, the built hydraulic fracturing system 100 may include at least one auxiliary manifold 104, at least one pop-off/bleed-off tank manifold 105, at least one isolation manifold 106, and/or a spacer manifold 107. The at least one pump manifold 103 may be used to inject a slurry into the wellbore in order to fracture the hydrocarbon bearing formation, and thereby produce channels through which the oil or gas may flow, by providing a fluid connection between pump discharge and the hydraulic fracturing system 100. The auxiliary manifold 104 may provide a universal power and control unit, including a power unit and a primary controller of the hydraulic fracturing system 100. The at least one pop-off/bleed-off tank manifold 105 may allow discharge pressure from bleed off/pop off operations to be immediately relieved and controlled. The at least one isolation manifold 106 may be used to allow pump-side equipment and well-side equipment to be isolated from each other. The spacer manifold 107 may provide spacing between adjacent equipment, which may include equipment to connect between the equipment in the adjacent manifolds.

In one or more embodiments, the manifolds 102, 103, 104, 105, 106, 107 may each include a primary manifold connection 110 with a single primary inlet and a single primary outlet and one or more primary flow paths extending therebetween mounted on same-sized A-frames 108. Additionally, the built hydraulic fracturing system 100 may be modular to allow for easy transportation and installation on the rig site. In a non-limiting example, the built hydraulic fracturing system 100 in accordance with the present disclosure may utilize the modular fracturing pad structure systems and methods, according to the systems and methods as described in U.S. patent application Ser. No. 15/943,306, which the entire teachings of are incorporated herein by reference. While not shown by FIG. 1, one of ordinary skill in the art would understand the built hydraulic fracturing system 100 may include further equipment, such as, a blowout preventer (BOP), completions equipment, topdrive, automated pipe handling equipment, etc. Further, the built hydraulic fracturing system 100 may include a wide variety of equipment for different uses; and thus, for the purposes of simplicity, the terms "plurality of devices" or "rig equipment" are used hereinafter to encompass the wide variety equipment used to form a built hydraulic fracturing system comprising a plurality of devices connected together.

Still referring to FIG. 1A, the automated hydraulic fracturing system may further include a plurality of sensors 111 provided at the rig site 1. The plurality of sensors 111 may be associated with some or all of the plurality of devices of the built hydraulic fracturing system 100, including components and subcomponents of the devices. In a non-limiting example, some of the plurality of sensors 111 may be associated with each of the valves of the wellhead assembly 101 and zipper manifold 102. The plurality of sensors 111 may be a microphone, ultrasonic, ultrasound, sound navigation and ranging (SONAR), radio detection and ranging (RADAR), acoustic, piezoelectric, accelerometers, temperature, pressure, weight, position, or any sensor in the art to detect and monitor the plurality of devices. The plurality of sensors 111 may be disposed on the plurality of devices at the rig site 1 and/or during the manufacturing of said devices. It is further envisioned that the plurality of sensors 111 may be provided inside a component of the plurality of devices. Additionally, the plurality of sensors 111 may be any sensor or device capable of wireline monitoring, valve monitoring, pump monitoring, flow line monitoring, accumulators and energy harvesting, and equipment performance and damage.

The plurality of sensors 111 may be used to collect data on status, process conditions, performance, and overall quality of the device that said sensors are monitoring, for example, on/off status of equipment, open/closed status of valves, pressure readings, temperature readings, and others. One skilled in the art will appreciate the plurality of sensors 111 may aid in detecting possible failure mechanisms in individual components, approaching maintenance or service, and/or compliance issues. In some embodiments, the plurality of sensors 111 may transmit and receive information/instructions wirelessly and/or through wires attached to the plurality of sensors 111. In a non-limiting example, each sensor of the plurality of sensors 111 may have an antenna (not shown) to be in communication with a master antenna 112 on any housing 113 at the rig site 1. The housing 113 may be understood to one of ordinary skill to be any housing typically required at the rig site 1 such as a control room where an operator 114 may be within to operator and view the rig site 1 from a window 115 of the housing 113. It is further envisioned that the plurality of sensors 111 may transmit and receive information/instructions to a remote location away from rig site 1. In a non-limiting example, that the plurality of sensors 111 may collect signature data on the plurality of devices and deliver a real-time health analysis of plurality of devices.

In one aspect, a plurality of sensors 111 may be used to record and monitor the hydraulic fracturing equipment to aid in carrying out the fracturing plan. Additionally, data collected from the plurality of sensors 111 may be logged to create real-time logging of operational metric, such as duration between various stages and determining field efficiency. In a non-limiting example, the plurality of sensors 111 may aid in monitoring a valve position to determine current job state and provides choices for possible stages. In some examples, the plurality of sensors may provide information such that a current state of the hydraulic fracturing operation, possible failures of hydraulic fracturing equipment, maintenance or service requirements, and compliance issues that may arise is obtained. By obtaining such information, the automated hydraulic fracturing systems may form a closed loop valve control system, valve control and monitoring without visual inspection, and reduce or eliminate human interaction with the hydraulic fracturing equipment.

An automated hydraulic fracturing system may include a computing system for implementing methods disclosed herein. The computing system may include an human machine interface ("HMI") using a software application and may be provided to aid in the automation of a built hydraulic fracturing system. In some embodiments, an HMI 116, such as a computer, control panel, and/or other hardware components may allow the operator 114 to interact through the HMI 116 with the built hydraulic fracturing system 100 in an automated hydraulic fracturing system. The HMI 116 may include a screen, such as a touch screen, used as an input (e.g., for a person to input commands) and output (e.g., for display) of the computing system. In some embodiments, the HMI 116 may also include switches, knobs, joysticks and/or other hardware components which may allow an operator to interact through the HMI 116 with the automated hydraulic fracturing systems.

An automated hydraulic fracturing system, according to embodiments herein, may include the plurality of sensors 111, valve control system 150, and data acquisition hardware disposed on or around the hydraulic fracturing equipment, such as on valves, pumps and pipelines. In some embodiments, the data acquisition hardware is incorporated into the plurality of sensors 111. In a non-limiting example, hardware in the automated hydraulic fracturing systems such as sensors, wireline monitoring devices, valve monitoring devices, pump monitoring devices, flow line monitoring devices, hydraulic skids including accumulators and energy harvesting devices, may be aggregated into single software architecture.

In one or more embodiments, single software architecture according to embodiments of the present disclosure may be implemented in one or more computing systems having the HMI 116 built therein or connected thereto. The single software architecture may be any combination of mobile, desktop, server, router, switch, embedded device, or other types of hardware may be used. For example, a computing system may include one or more computer processors, non-persistent storage (e.g., volatile memory, such as random access memory (RAM), cache memory), persistent storage (e.g., a hard disk, an optical drive such as a compact disk (CD) drive or digital versatile disk (DVD) drive, a flash memory, etc.), a communication interface (e.g., Bluetooth interface, infrared interface, network interface, optical interface, etc.), and numerous other elements and functionalities.

A computer processor(s) may be an integrated circuit for processing instructions. For example, the computer processor(s) may be one or more cores or micro-cores of a processor. Fracturing plans according to embodiments of the present disclosure may be executed on a computer processor. The computing system may also include one or more input devices, such as a touchscreen, keyboard, mouse, microphone, touchpad, electronic pen, or any other type of input device. Additionally, it is also understood that the computing system may receive data from the sensors described herein as an input.

A communication interface may include an integrated circuit for connecting the computing system to a network (not shown) (e.g., a local area network (LAN), a wide area network (WAN) such as the Internet, mobile network, or any other type of network) and/or to another device, such as another computing device. Further, the computing system may include one or more output devices, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s), non-persistent storage, and persistent storage. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure. More specifically, the software instructions may correspond to computer readable program code, that when executed by a processor(s) may perform one or any of the automated hydraulic fracturing systems features described herein, including that associated with data interpretation and automated hydraulic fracturing systems.

Additionally, the software instructions may create a log of activities and users. In a non-limiting example, the log may maintain and monitor the operator 114 or others signing-in and signing-out, time usage of the fracturing plan, amount of times the fracturing plan was modified, amount times the operator 114 manually overrides the fracturing plan, maintenance of the plurality of devices, online and offline sensors, each modification added to the fracturing plan, and other operations performed at the rig site 1.

The computing system may implement and/or be connected to a data repository, such as a database, which may be used to store data collected from an automated hydraulic fracturing system according to embodiments of the present disclosure. Such data may include, for example, valve data, such as identification of which valves in the system are open or closed, time recordings of when valves in the system open or close, time periods for how long valves in the system are open or closed, and valve pressure data. A database is a collection of information configured for ease of data retrieval, modification, re-organization, and deletion. The computing system of may include functionality to present raw and/or processed data, such as results of comparisons and other processing performed by an automation planner. For example, data may be presented through the HMI 116. The HMI 116 may include a graphical user interface (GUI) that displays information on a display device of the HMI 116. The GUI may include various GUI widgets that organize what data is shown as well as how data is presented to a user (e.g., data presented as actual data values through text, or rendered by the computing device into a visual representation of the data, such as through visualizing a data model).

The above description of functions presents only a few examples of functions performed by the computing system of automated hydraulic fracturing systems. Other functions may be performed using one or more embodiments of the disclosure.

The plurality of sensors 111 work in conjunction with the computer system to display information on the HMI 116. Having the automated hydraulic fracturing system may significantly improve overall performance of the rig, rig safety, reduced risk of NPT and many other advantages. Embodiments of the present disclosure describe control systems, measurements, and strategies to automating rig operation (e.g., fracturing operations). It is further envisioned that the automated hydraulic fracturing system may locally collect, analyze, and transmit data to a cloud in real-time to provide information, such as equipment health, performance metrics, alerts, and general monitoring, to third parties remotely or through the HMI 116.

In some embodiments, a fracturing plan may be provided on the software application such that the fracturing plan may be displayed on the HMI 116. The fracturing plan may be a set of instructions to perform multiple processes in a hydraulic fracturing operation. In a non-limiting example, the instructions may include a sequence of valve operations to direct fluid flow through a selected path in one or more of the wellhead assemblies and manifolds on the frac pad, with the sequence of valve operations being automatically controlled by the software through a valve control system associated with the valves. Further, the HMI 116 may have an emulate mode that can visually show the path through which fluid can flow by monitoring the valve positions to determine current job state and provides choices for possible stages. The emulate mode may allow the operator 114 to simulate a next stage of the fracturing operation prior to making changes to the fracturing plan. It is further envisioned that the software application may include a simulation system such that the fracturing plan may be simulated and said results may be displayed on the HMI 116. Based on the simulated results, the fracturing plan may be modified to create a customized fracturing plan to be executed on the plurality of devices of the automated hydraulic fracturing system 10. One skilled in the art will appreciate how the HMI 116 may allow the operator 114 to monitor, change, or shut down fracturing operation. In a non-limiting example, the HMI 116 may send permission requests to the operator 114 to perform various instructions from the fracturing plan and/or the customized fracturing plan. Additionally, the HMI 116 may include visual cues to allow for the monitoring and detection of a wireline stage, send alerts of a valve leak, and/or any erosion/corrosion caused by the flow of fluids in the plurality of devices.

In one or more embodiments, the plurality of sensors 111 may communicate with the software application on the computer system of the HMI 116 to automate the plurality of devices, such as a valve. In a non-limiting example, the fracturing plan may include an automated valve sequencing (e.g., when to open and close) during completion stage based on pre-approved sequence.

Figure 1B:
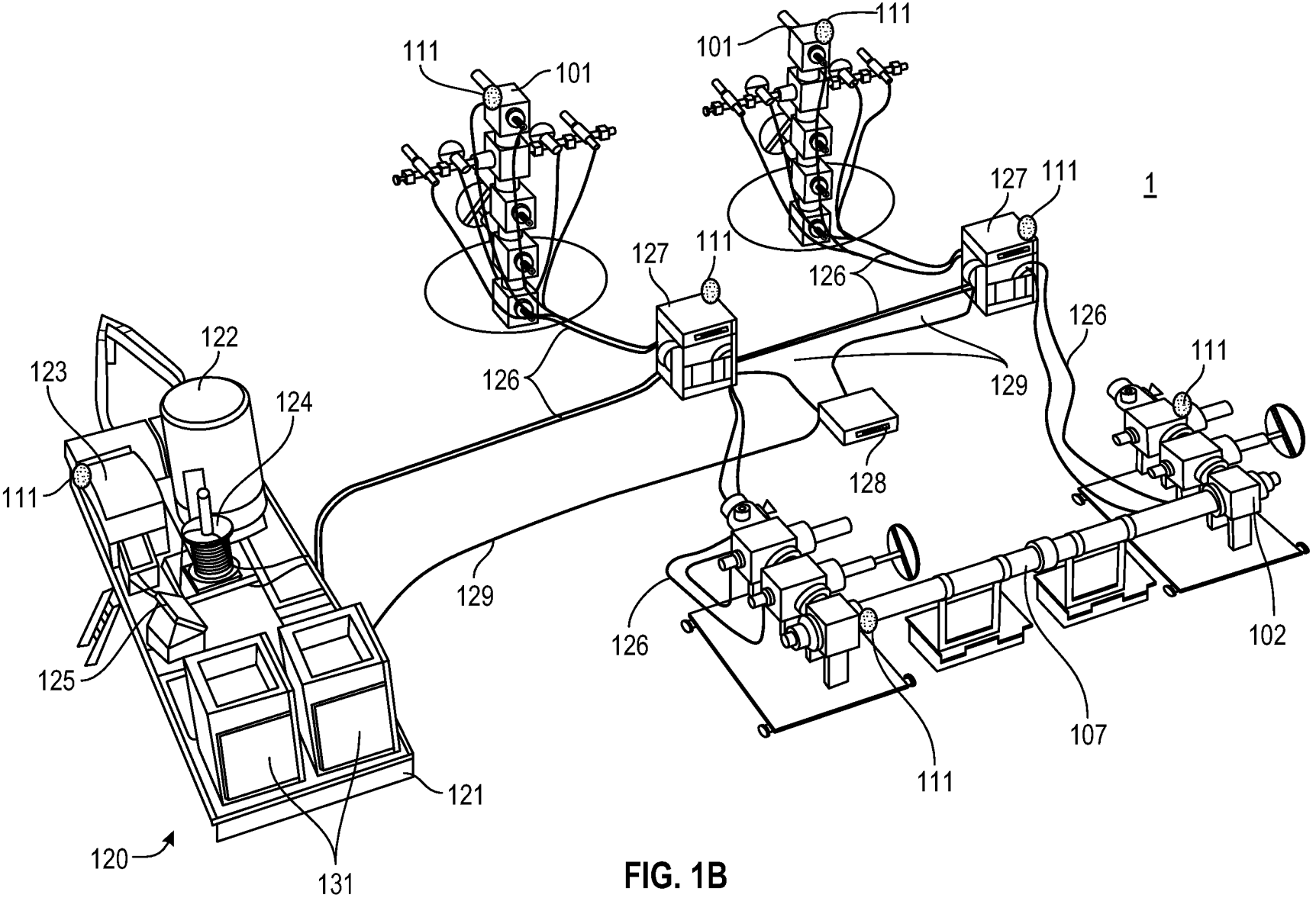
Figure 1C:
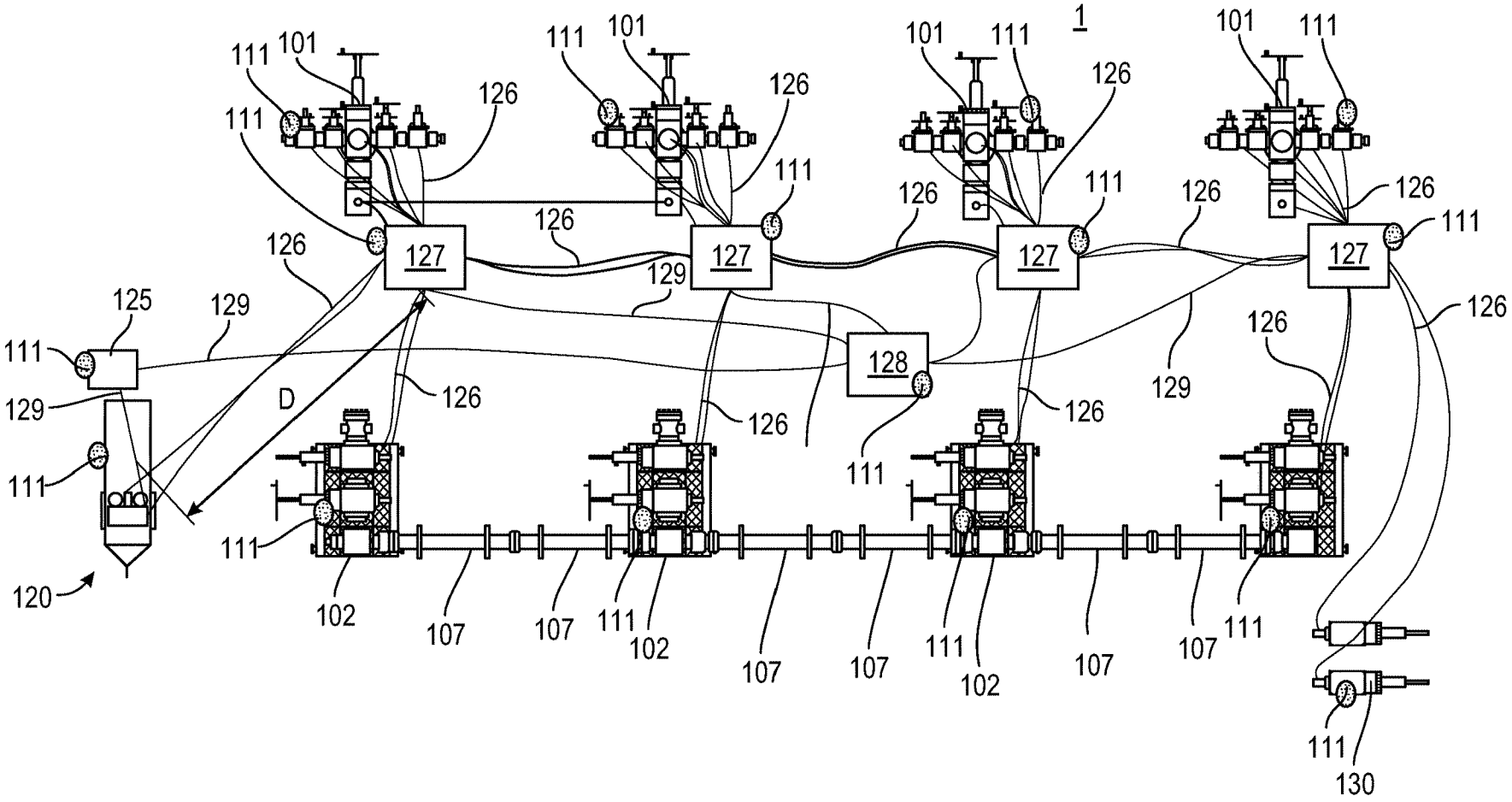
Figure 2:
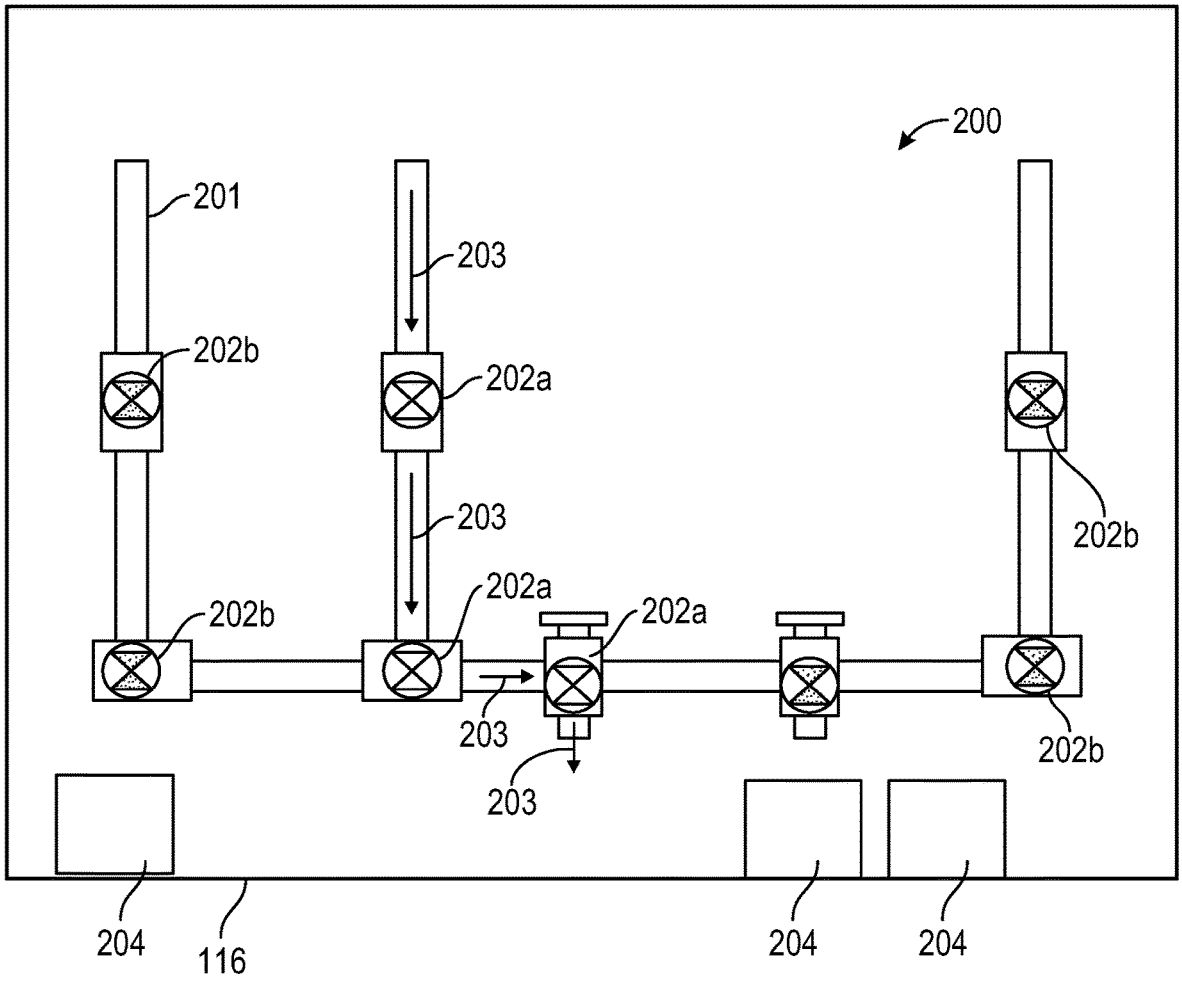
FIG. 2 illustrates a view of a human machine interface ("HMI") of the hydraulic fracturing system of FIGS. 1A-1C according to one or more embodiments of the present disclosure.

With reference to to FIG. 2, FIG. 2 shows a non-limiting example of a simulated hydraulic fracturing system displayed on the HMI 116. The simulation may include a plurality of equipment/devices 201 of a hydraulic fracturing system 200 arranged and connected together as they would be in the built hydraulic fracturing system (see 100 of FIGS. 1A-1C). The simulation may further show positions of devices being monitored and/or controlled through the system. In a non-limiting example, the simulation may display the open and closed positions of valves (e.g., see 202*a* for open and 202*b* for closed) in the hydraulic fracturing system 200, thereby indicating the available path of fluid flow (see arrows 203) through the system. The simulation may be used to simulate the outcome of a phase of hydraulic fracturing if selected devices were to be operated under certain parameters (e.g., if selected valves were opened or closed, if selected pumps were on or off, etc.). In some embodiments, the simulation may be used to evaluate performance and/or outcomes of hydraulic fracturing operations that have not yet been built or have not yet been operated. In some embodiments, the simulation may be used to simulate actual performance of an already built and in-use hydraulic fracturing system in order to monitor and evaluate the actual performance, which may be used, for example, to help make decisions on next steps in the operation. It is further envisioned that the HMI 116 may be a touch screen such that the operator (114) may open and close valves directly through the HMI 116. Additionally, the HMI 116 may have buttons or portions of the touch screen 204 corresponding to commands in the simulated hydraulic fracturing system.

Additionally, the HMI 116 may store and display a logging of the operator 114 requesting valve operations and real-time logging of operational metric such as duration between various stages and determining field efficiency. Further, the HMI 116 may have a notification of current stage and alarming when valve moves out of place, such that an automated notification of possible hazards in actuating certain valves may be displayed on the the HMI 116.

Referring back to FIG. 1A, it is further envisioned that the plurality of sensors 111 may be used to determine a real-time conditioning of the plurality of devices, such as a valve (e.g., gate valve). In a non-limiting example, the software application, in one method, may instruct the plurality of sensors 111 to monitor a hydraulic pressure and stroke signature of the valve. The software application may then correlate said readings with a known pattern determined by experimentally and theoretically calculated data on the valve operating under good lubrication. Further, the pressure stroke signature may be known to follow a fixed pattern for specific valves. In an additional approach, the software application may instruct the plurality of sensors 111 to monitor hydraulic pressure spikes and volume of hydraulic fluid to determine a health status of the valve. In particular, algorithms based on a valve type may be used to determine when the valve is failing due to, for example, poor greasing conditions. It is further envisioned that the plurality of sensors 111 may utilize a combination of vibration and strain sensors to determine load on the valve stem and may correlate said load to an overall health of the valve.

Furthermore, a safety measure may be programmed in the software application such that the plurality of sensors 111 may automatically count a number of times a valve is opened and closed. Based on said safety measure, an automatic trigger may actuate such that the valve is greased once a pre-determined number of valve actuations (e.g., open/closed) has been reached. One skilled in the art will appreciate how once greasing requirements are determined, a specific volume of grease based on the condition of the valve may be automatically pumped into the gate valve to keep it running smoothly. In a non-limiting example, the software application, through the plurality of sensors 111, may regulate an air manifold to prevent over-pressure of devices. The software application may use data based on the real-time valve position to prevent overpressure or other costly mistakes during the fracturing operations. It is further envisioned that safety and efficiency at the rig site may be increased by providing automated actuation of valves, remotely and outside of a red-zone (e.g., an area approximate the plurality of devices).

As shown in FIG. 1A, in one or more embodiments, an automatic greasing unit 120 may be provided at the rig site 1 and may determine a greasing period and grease quantity by utilizing data collected by the plurality of sensors 111 placed on the plurality of devices and the automatic greasing unit 120. Additionally, the automatic greasing unit 120 may receive and transmit data from and to the HMI 116. Additionally, valve utilization may be used to further determine greasing requirements. The valve utilization may take into consideration, for example, duration a valve was exposed to a fracturing stage and the software application may determine the greasing requirements based on the amount of sand the valve may have been in contact with and the bore pressures. It is further envisioned that a valve signature may be analyzed and intelligence protocols may be applied to ensure the valves may only be greased when necessary based on time or number of actuations. Further, the plurality of sensors 111 may measure a pressure feedback during greasing to ensure efficient application of grease.

FIG. 1B shows a close-up perspective view of an automatic greasing unit 120 at a rig site 1 approximate the at least one wellhead assembly 101 and the zipper manifold 102 according to one or more embodiments of the present disclosure. The automatic greasing unit 120 may include various equipment coupled to various equipment at the rig site 1. For example, the automatic greasing unit 120 may have a grease tank 122 and a compressor 123 that may be operationally coupled to a grease pump 124 disposed on a trailer 121. In a non-limiting example, the compressor 123 may provide compressed air to the grease pump 124 such that grease is pumped from the grease tank 122. Additionally, generators 131 may be provided on the trailer 121 to power the automatic greasing unit 120. Furthermore, a control panel 125 may be provided on the trailer 121 to operate the automatic greasing unit 120. From the trailer 121, grease and air lines 126 may connect to at least one wellhead assembly 101 and the zipper manifold 102 via one or more grease manifolds 127. The grease manifolds 127 may be positioned within a red zone at the rig site 1. The red zone may be a danger area around equipment unsafe for workers to approach. The grease manifolds 127 may include pneumatically operated valves that open to direct grease to the corresponding valve in the at least one wellhead assembly 101 or the zipper manifold 102. Although the system depicted uses pneumatically-operated vales, other valve types, including hydraulic and electric, may be used.

The pneumatically operated valves may be electronically controlled using electric control valves to direct air where needed to open/close the pneumatically operated grease valves. In some embodiments, the control panel 125 may electronically control the opening and closing of the electronically controlled valves to direct air to open and close the pneumatically operated grease valves.

In addition, an intermediate automation control box 128 may be provided at the rig site 1. Cables 129 may couple the control panel 125 to the intermediate automation control box 128. With the cables 129, the intermediate automation control box 128 may receive electric power and control signals from the control panel 125 located outside of the red zone. For instance, the intermediate automation control box 128 may receive a control signal from the control box 128 indicating that a particular valve of a frac tree needs to be greased, and the intermediate automation control box 128 may respond by sending control signals to the manifold 127 associated with that frac tree and to the control valves within the manifold 127 necessary to grease the identified valves. Further, the intermediate automation control box 128 may reduce the power received from the control panel 125, and then send lower level power and control signals to the valves in the grease manifolds 127 necessary to grease the corresponding valve(s) indicated by the control panel 125. By providing the step-down in power from the intermediate automation control box 128, the grease manifolds 127 may be positioned closer to the wellhead assembly 101 (e.g., trees), which may decrease the needed length of costly grease lines. Further, by providing the step-down in power from the intermediate automation control box 128, expensive electronically controlled valves that are rated to be used in areas with potentially explosive gases do not need to be used.

In conjunction with the plurality of sensors 111, the control panel 125 or the intermediate automation control box 128 may automatically determine when to grease a valve based on the valve signature. It is further envisioned that the control panel control panel 125 and the intermediate automation control box 128 may communicate with the HMI (116) as described in FIG. 2.

Referring now to FIG. 1C, another embodiment of the automatic greasing unit 120 at the rig site 1 according to embodiments herein is illustrated, where like numerals represent like parts. The embodiment of FIG. 1C is similar to that of the embodiment of FIG. 1B. However, instead of the control panel 125 provided on the trailer 121 of the automatic greasing unit 120 (see FIG. 1B), the control panel 125 is provided on the rig site 1 a distance from the trailer 121. The trailer 121 may be spaced a distance D from the grease manifolds 127 such that the automatic greasing unit 120 is outside the red zone. Additionally, secondary spare valves 130 may be disposed at the rig site 1. The secondary spare valves 130 may be coupled to the grease manifolds 127 via grease and air lines 126 such that the secondary spare valves 130 remained greased and ready for use.

According to embodiments of the present disclosure, a system for a hydrocarbon recovery operation may include a frac tree having at least one valve and being associated with a red zone surrounding the frac tree. A manifold positioned in the red zone may be in fluid communication with the valve(s). A control panel may be positioned outside the red zone, and an automation box may be positioned within the red zone, where the automation box is electrically connected to the control panel and to the manifold. The automation box may receive electrical power at a first level and outputs electrical power to the manifold and a second level, lower than the first level.

The system may further include a grease source positioned outside the red zone and fluidly connected to the manifold. The manifold may include one or more control valves configured to cause grease from the grease source to be injected into the valve(s) associated with the red zone, where the automation box may transmit control signals to the control valves in response to control signals received from the control panel. One or more sensors may be coupled to the valve(s) and are in communication with the control panel, which may allow signals related to information about the valves (e.g., temperature, open/close status, pressure) to be sent to the control panel. For example, the control panel may automatically identify when to grease the valve(s) based, at least in part, on the sensors.

According to embodiments of the present disclosure, a general plan suitable for use in planning a majority of hydraulic fracturing operations may be generated into a template fracturing plan. Thus, a template fracturing plan may include an outline or overview of high level phases for hydraulic fracturing operations and an initial set of instructions for how activities within the high level phases may be performed. A template fracturing plan may later be modified (e.g., by an end user or third party) to accommodate a particular standard operating procedure or to fit a particular hydraulic fracturing operation. For example, a user may modify a template fracturing plan to include one or more discrete plans, for example, to fit a particular hydraulic fracturing operation or standard operating procedure. One or more modifications to a template fracturing plan may include, for example, alternating the timing of valve openings, alternating a particular valve leak test to perform for each kind of valve, and alternating pressure testing methods.

In some embodiments, a template fracturing plan may be modified to include instructions for which steps in a hydraulic fracturing operation can proceed with and without human permission. Permission settings may be predefined in a modified fracturing plan to have certain steps require a user permission prior to proceeding and/or to have certain steps automatically proceed upon meeting certain system parameters. In some embodiments, permission settings may include one or more approval settings (e.g., who has credentials or who needs to approve certain steps in a hydraulic fracturing operation), a log of users and/or a log of decisions to approve or disallow actions and who made the decisions. As a simplified example of modifying a template fracturing plan, a template fracturing plan may include instructions that if steps a, b and c go according to plan in a built hydraulic fracturing system, the operation may automatically proceed with step d, where the template fracturing plan may be modified to request permission before proceeding with one or more of steps a, b, c and d.

Figure 3:
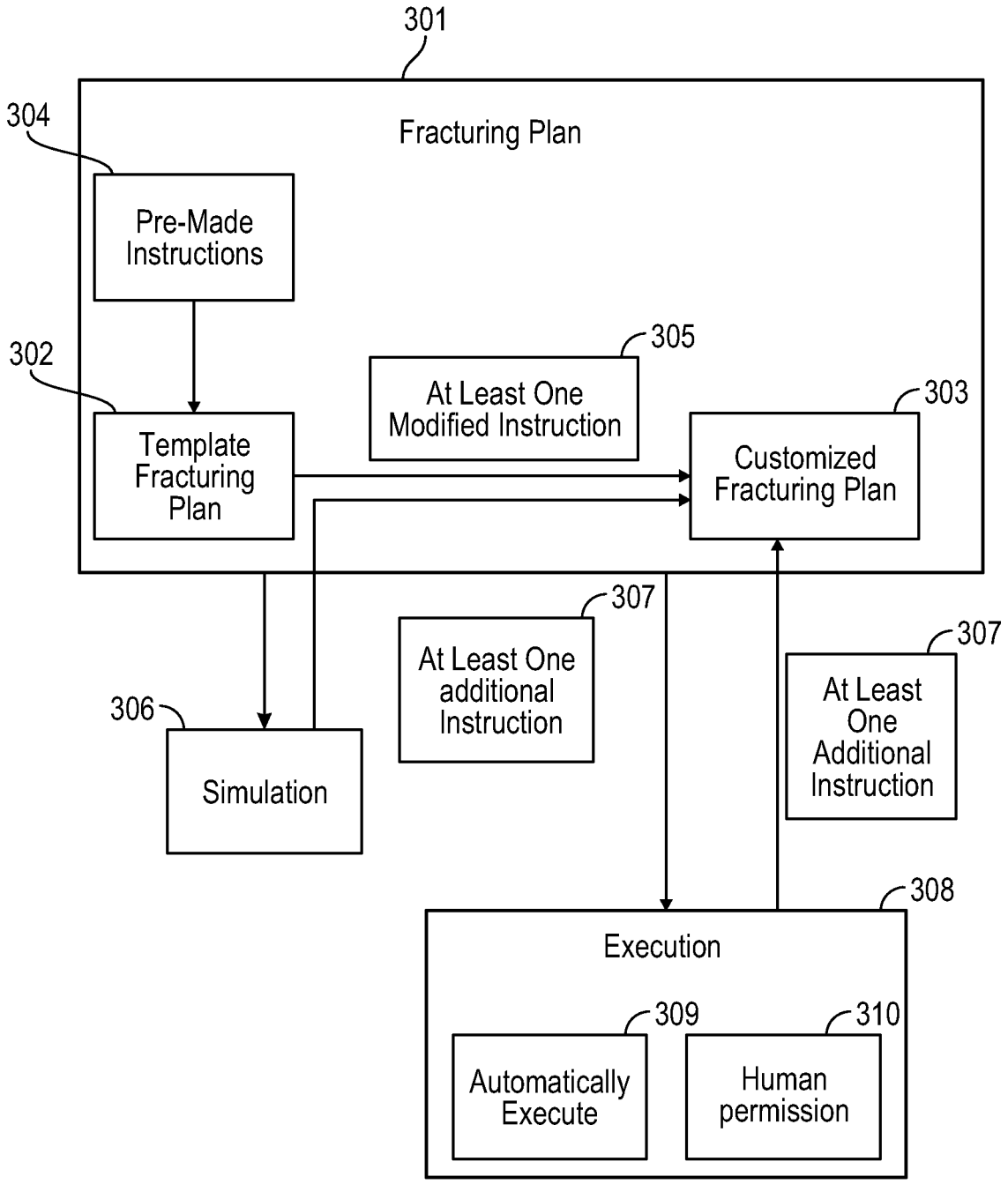
FIG. 3 illustrates a flowchart of automating a hydraulic fracturing system at a well site according to one or more embodiments of the present disclosure.

Referring to FIG. 3, in one or more embodiments, a system flow chart is shown of implementing an automated hydraulic fracturing system on the built hydraulic fracturing system 100 at the rig site 1 of FIG. 1A. The automated hydraulic fracturing system may include a fracturing plan 301. In a non-limiting example, the fracturing plan 301 may include a list of activities for each phase of a hydraulic fracturing operation, such as: during a toe prep phase of an operation, activities may include standby, logging, pressure testing, and injection testing; during a zipper frac phase of an operation, activities may include standby, wireline, and fracturing; and during a drill out phase of an operation, activities may include standby and coiling. For each activity in each phase, the fracturing plan 301 may include settings for one or more device types in the hydraulic fracturing system, such as on/off positions of each valve in the system, pressure minimums and maximums, and others described herein. Furthermore, one of ordinary skill in the art would understand the fracturing plan 301 may include further operations, such as, a water and additive injection, initiating the hydraulic fracturing of the formation, the actuation of downhole equipment, or any operation during the life of a well.

In some embodiments, the fracturing plan 301 may be developed from one or more sets of pre-made instructions organized into a template fracturing plan 302, which may include instructions to perform multiple processes carried out by the built hydraulic fracturing system 100. In a non-limiting example, the template fracturing plan 302 may be designed prior to building the built hydraulic fracturing system 100 at a rig site such that the fracturing plan 301 may apply to any configuration of the plurality of devices. It is further envisioned that the fracturing plan 301 may be modified to form a customized fracturing plan 303. The customized fracturing plan 303 may include pre-made instructions 304 from the template fracturing plan 302 and at least one modified instruction 305. In a non-limiting example, the at least one modified instruction 305 may be inputted into the software application by a third party such as an operator with access to the software application through the HMI.

In one or more embodiments, the fracturing plan 301 (a template fracturing plan 302 and/or a customized fracturing plan 303) may be run in a simulation 306 prior to performing an operation at the rig site. In a non-limiting example, the software application may include a simulation package such that the simulation 306 may be run to show fluid flow through the plurality of devices of the built hydraulic fracturing system 100 to a well bore or show the performance of individual components. It is further envisioned that the fracturing plan 301 may use limit switches to determine the valve positions on a fracturing operation. In addition, said limit switches may be incorporated within an isolation valve, tree valve, and/or manifold valve to monitor and transit positions of said valves. One skilled in the art will appreciate how the positions of said valves may determine a current stage of well as well as possible next stages during the fracturing operation. Further, the positions of said valves may be fed into a controller to enable a hydraulic valve to be automated in a safe manner.

Furthermore, a plurality of sensors (e.g., sensors 111 in FIG. 1A) may be disposed in and/or on the plurality of devices to measure data. It is also understood that depending on the piece of equipment (and its usage and/or importance), different numbers and/or types of sensors may be used. In a non-limiting example, the plurality of sensors 307 may collect data and display the data on the HMI to allow for real-time monitoring and updates. The plurality of sensors 307 are located on relevant equipment on locations where they can gather data and be able detect any changes to the plurality of devices such as performance and possible damage. For example, a pump may have a sensor disposed at the inlet thereof, as well as, a sensor at the outlet thereof. Further examples may be a valve manifold that has a sensor disposed on the outer surface thereof, as well as, a sensor on an inner flow bore, or a sensor may be disposed on a valve within the flow bore to measure a position of the valve. It is further envisioned that pressure lines may be measured in a central location, such that, the sensor(s) connected to the pressure lines measures multiple pieces of equipment. Additionally, one of ordinary skill in the art will appreciate how the present discourse is not limited to just the data listed above and may include any effects on the plurality of devices.

With data collected from the plurality of sensors, in one or embodiments, an execution 308 of the fracturing plan 301 (a template fracturing plan 302 or a customized fracturing plan 303) may be performed on the plurality of devices of the built hydraulic fracturing system 100. In a non-limiting example, the software application may automatically execute 309 the fracturing plan 301. In some embodiments, to perform the execution 308, the pre-made instructions and the at least one modified instruction may be sent to remotely operable hardware on the plurality of devices to perform a function (e.g., to achieve facture). It is further envisioned that, an alert may occur on the HMI, such as a sound and/or visual cue. The alert may indicate that an operation requires human permission 310 to execute the customized fracturing plan prior to sending instructions to the plurality of devices. Additional alerts may also occur, such as from computer vision sensors that may detect personnel within an area of the built hydraulic fracturing system 300 at the rig site (e.g., if an entity has come within a restricted or hazardous area of the rig site). Furthermore, the plurality of sensors may, for example, monitor pressure data at a high sample rate to capture high pressure events for compliance and safety requirements. Additionally, the fracturing plan 301 may include a time to complete processes for each stage and the plurality of sensors may further provide information to modify said plans (301, 303) to improve operational efficiency.

According to embodiments of the present disclosure, data collected from simulation 306 of a fracturing plan 301 and/or execution 308 of a fracturing plan 301 may indicate that one or more additional instructions 307 may be added to a customized fracturing plan 303 in order to optimize fracturing operations (e.g., make the operations safer, utilize less energy, utilize less material, etc.)

In one or more embodiments, the software application of the automated hydraulic fracturing system may automatically generate optimal responses by using artificial intelligence ("AI") and/or machine learning ("ML"). In a non-liming example, the optimal responses may be due to unforeseen events such as downhole conditions changing, equipment failures, weather conditions, and/or hydraulic fracturing performance changing, where the fracturing plan 301 may automatically change corresponding to the optimal responses. The optimal responses may optimally and automatically reroute the fracturing plan 301 in view of the unforeseen events and potentially unidentified risks. It is further envisioned that the plurality of sensors may continuously feed the software application data, such that addition optimal responses may be suggested on the HMI for the operator to accept or reject. In some embodiments, the operator may manually input, through the HMI, modification to the fracturing plan 301. One skilled in the art will appreciate how the software application, using AI and/or ML, may learn the manual input from the operator such that predications of potential interruptions in the fracturing plan 301 may be displayed on the HMI and corresponding optimal responses.

Figure 4:
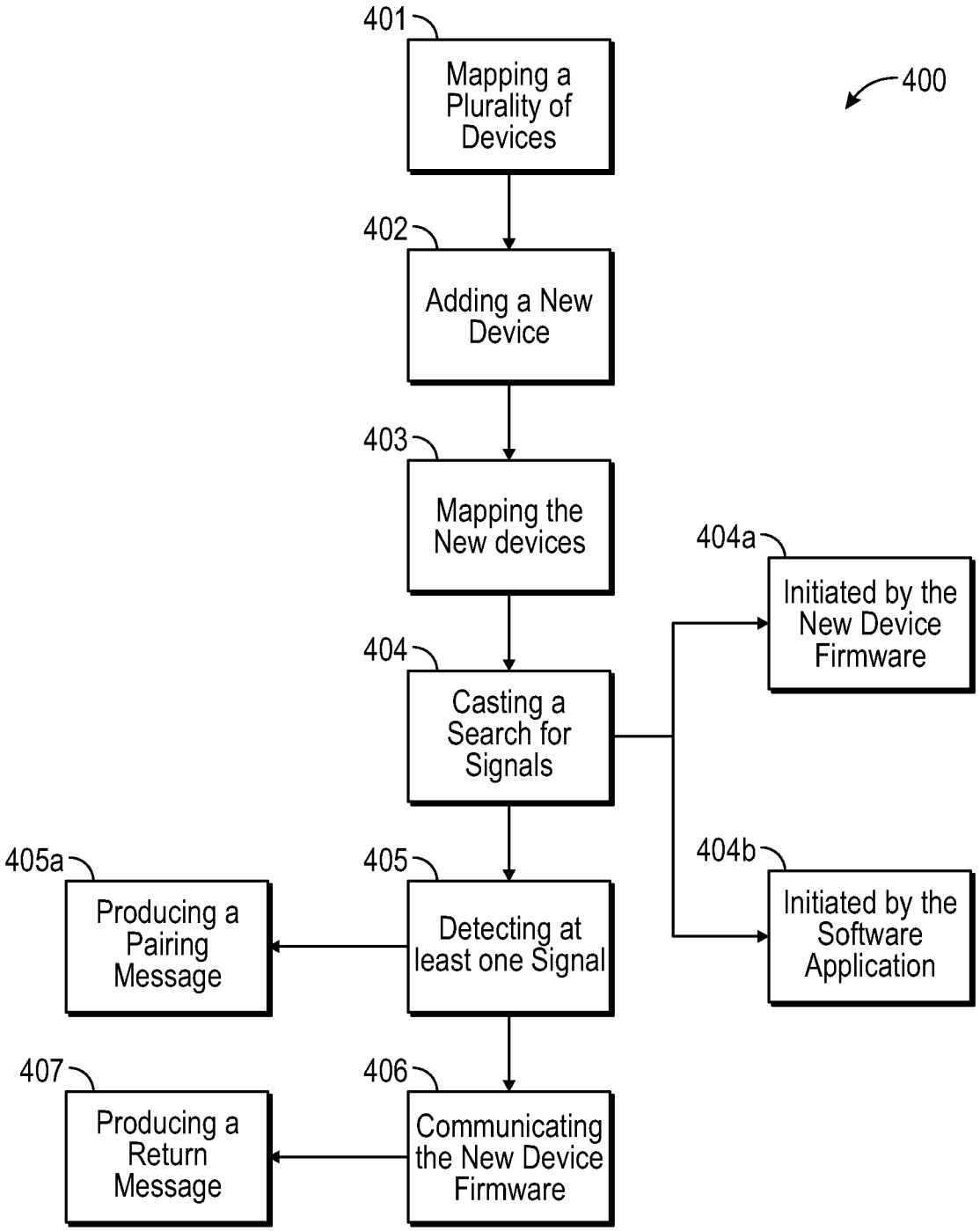
FIG. 4 illustrates a flowchart of a simulated hydraulic fracturing system according to one or more embodiments of the present disclosure.

Now referring to FIG. 4, FIG. 4 shows a system flow chart for developing a simulation of a hydraulic fracturing system 400 according to one or embodiments of the present disclosure. In step 401, a plurality of devices in a hydraulic fracturing operation may be mapped into a simulated hydraulic fracturing system 400 using a software application. After a hydraulic fracturing operation has been mapped into a simulated system, one or more devices may be subsequently added or removed from the simulated hydraulic fracturing system. For example, a new device may be added to the hydraulic fracturing system 400 in step 402. In a non-limiting example, the new device may include firmware and/or programmable logic controllers (PLCs) capable of communicating with the software application. One skilled in the art will appreciate how the firmware may be in a format compatible with the software application. Additionally, in step 403, the new device is mapped into the simulated hydraulic fracturing system 400, where the new device may be identified, for example, by device type, device specifications, or others, and/or the new device location may be identified with reference to previously mapped devices in the hydraulic fracturing system. In a non-limiting example, the new device may be a valve in a flow path.

Equipment and/or devices of a hydraulic fracturing operation may be initially simulated in a simulated hydraulic fracturing system or equipment/devices in an already built hydraulic fracturing system may be simulated in a simulated hydraulic fracturing system. For example, according to some embodiments, commonly used devices in general hydraulic fracturing systems may be initially simulated into a simulated hydraulic fracturing system in order to design a template fracturing plan, as described above. In some embodiments, equipment in a built hydraulic fracturing system may be mapped into a simulated hydraulic fracturing system, where new devices may subsequently be added and mapped into the simulated hydraulic fracturing system.

In some embodiments, mapping a new device into a simulated hydraulic fracturing system may include first casting a search for signals within a radius encompassing a built hydraulic fracturing system in step 404. It is further envisioned that the step 404 may be initiated by the new device firmware 404*a* or by the software application 404*b*. Next, in step 405, at least one signal from the new device firmware is detected. Further to step 405, the firmware may produce a pairing message, such as a beacon, in step 405*a* to aid in detection. With the at least one signal detected, the new device firmware may communicate with the software application in step 406. Furthermore, to ensure that the firmware is connected to the software application, the firmware may have an application programming interface (API) to produce a return message in step 407 to confirm that communication is allowable. With the new device connected to the software application, the new device may be mapped into a simulated hydraulic fracturing system, monitored, and/or controlled through the software application.

For example, a valve (e.g., a valve used in a built hydraulic fracturing system 100) may be added into a simulated hydraulic fracturing system using a method such as shown in FIG. 4, where the valve may be provided with firmware capable of sending and/or receiving signals from the software application simulating the simulated hydraulic fracturing system. Once added in the simulated hydraulic fracturing system, the simulated hydraulic fracturing system 400 may monitor a level of grease in the valve, determine when to grease the valve, and/or send an alert or command to lubricate the valve (e.g., where the valve may be automatically lubricated from an automatic greasing unit 120 or personnel may add lubricate upon being noticed of the alert). In some embodiments, these steps may be performed in a control panel or intermediate automation box similar to those depicted above in FIGS. 1B and 1C Additionally, depending on the type of the valve, the simulated hydraulic fracturing system 400 may determine a number of strokes of the valve and be able transmit said data to ensure maintenance requirements of the valve are meet.

In addition to the benefits described above, the automated hydraulic fracturing system may improve an overall efficiency and performance at the rig site while reducing cost. Further, the automated hydraulic fracturing system may provide further advantages such as a complete closed loop valve control system, valve transitions may be recorded without visual inspection, partial valve transitions may be avoided, valve transition times may be optimized given the closed loop feedback, an automated valve rig up/checkout procedure may ensure that the flow lines have been attached to the intended actuators, and may reduce or eliminate human interaction with the rig equipment to reduce communication/confusion as a source of incorrect valve state changes. It is noted that the automated hydraulic fracturing system may be used for onshore and offshore oil and gas operations.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

providing a template fracturing plan on a software application, the template fracturing plan comprising premade instructions to perform multiple processes carried out by a multi-well hydraulic fracturing system comprising a plurality of devices connected together, the plurality of devices comprising:

a zipper manifold;

a pump manifold fluidly connecting one or more high pressure pumps to the zipper manifold;

multiple wellhead assemblies fluidly connected to the zipper manifold;

a plurality of valves, the plurality of valves comprising wellhead valves associated with each of the multiple wellhead assemblies; and a valve control system connected to and providing power to actuate the plurality of valves;

wherein the pre-made instructions comprise instructions to control the plurality of valves according to a valve sequencing for at least one process of the multiple processes to direct fluids in a selected path through the multi-well hydraulic fracturing system using the valve control system, modifying the template fracturing plan to create a customized fracturing plan, the customized fracturing plan including the pre-made instructions and at least one modified instruction; and executing the customized fracturing plan to perform the at least one process in a built hydraulic fracturing system comprising the plurality of devices of the multi-well hydraulic fracturing system, the executing comprising:

using the valve control system to automatically control the plurality of valves to direct fluids through the selected fluid flow path according to the valve sequencing for the at least one process.

2. The method of claim 1, further comprising simulating performing the at least one process in the built hydraulic fracturing system on the software application prior to performing.

3. The method of claim 1, further comprising monitoring the performance of the customized fracturing plan;

wherein monitoring includes collecting data from a plurality of sensors disposed along the plurality of devices.

4. The method of claim 1, wherein the executing is performed by sending instructions selected from the pre-made instructions and the at least one modified instruction to remotely operable hardware on the plurality of devices.

5. The method of claim 1, wherein the pre-made instructions comprise a sequence of valve operations for each of the multiple processes.

6. The method of claim 1, wherein the method further comprises detecting a non-routine process interruption.

7. The method of claim 1, wherein the software application generates at least one additional instruction to modify the customized fracturing plan.

8. A system, comprising:

a built hydraulic fracturing system comprising a plurality of devices connected together, the plurality of devices comprising:

a zipper manifold;

a pump manifold fluidly connecting one or more high pressure pumps to the zipper manifold;

multiple wellhead assemblies fluidly connected to the zipper manifold;

a plurality of valves, the plurality of valves comprising wellhead valves associated with each of the multiple wellhead assemblies; and a valve control system connected to and providing power to actuate the plurality of valves;

a simulation of the built hydraulic fracturing system on a software application;

a fracturing plan provided on the software application, the fracturing plan comprising instructions to perform multiple processes in a hydraulic fracturing operation;

wherein the instructions comprise a sequence of valve operations for the plurality of valves to direct fluid flow through a selected path through the built hydraulic fracturing system to one or more of the multiple wellhead assemblies, and wherein the software application further comprises instructions to automatically control the plurality of valves according to the selected path using the valve control system.

9. The system of claim 8, wherein the simulation of the built hydraulic fracturing system visually shows, on a human machine interface, valve positions of the plurality of valves and the selected path of fluid flow through the plurality of valves for a selected process.

10. The system of claim 8, wherein the instructions further comprise permission requests from a human operator to change the selected path.

* * * * *